US012752214B2

(12) United States Patent
Huang

(10) Patent No.: US 12,752,214 B2
(45) Date of Patent: Oct. 6, 2026

(54) COMBINED-TYPE SMOKE GENERATOR

(71) Applicant: Shenzhen Yinermei Technology Co., Ltd., Shenzhen (CN)

(72) Inventor: Zhiyi Huang, Shenzhen (CN)

(73) Assignee: Shenzhen Yinermei Technology Co., Ltd., Shenzhen (CN)

( * ) Notice: Subject to any disclaimer, the term of this patent is extended or adjusted under 35 U.S.C. 154(b) by 178 days.

(21) Appl. No.: 18/900,982

(22) Filed: Sep. 30, 2024

(65) Prior Publication Data

US 2026/0091324 A1 Apr. 2, 2026

(51) Int. Cl.
*A63J 5/02* (2006.01)

(52) U.S. Cl.
CPC . *A63J 5/025* (2013.01); *A63J 5/02* (2013.01)

(58) Field of Classification Search
CPC ..... A63J 5/00; A63J 5/02; A63J 5/025; B05B 17/00; B05B 7/00
See application file for complete search history.

(56) References Cited

U.S. PATENT DOCUMENTS 9,841,433 B2 * 12/2017 Norris ..... A63J 5/025
2019/0213850 A1 * 7/2019 Liu ..... B05B 17/0676

* cited by examiner

*Primary Examiner* — Nathan J Flynn
(74) *Attorney, Agent, or Firm* — Bayramoglu Law Offices LLC

(57) ABSTRACT

A combined-type smoke generator includes a shell. A battery is installed on one side of bottom inside shell, an electrode needle is installed on one side of top inside shell, an air pump is installed on the other side of bottom inside shell, a connecting assembly is installed on the other side of top inside shell, a smoke compartment is installed on the left side of top of shell, an air inlet is installed on the right side of the smoke compartment, a control assembly is installed on the front side of the shell, the top of the electrode needle is connected to the bottom of the smoke compartment, the battery is connected electrically to the electrode needle, the air pump is connected through the connecting assembly to the air inlet of the smoke compartment, and the control assembly is connected electrically to the battery and the air pump respectively.

6 Claims, 5 Drawing Sheets

COMBINED-TYPE SMOKE GENERATOR

TECHNICAL FIELD

The present invention relates to the field of invention of atomization, in particular to a combined-type smoke generator.

BACKGROUND

The photography and film-television industry is always looking for innovative methods to enhance visual expression and emotional depth. In the early stage, smoke was simulated by natural conditions or vapor effect made artificially, but these methods were limited by the factors such as uncontrollability, timeliness, and safety. With the advancement of technology, especially the development of electronic and chemical technology, professional smoke generator has gradually become an indispensable tool in the field of film and television production and photography. At present, the air inlet of the smoke generator available in the market is installed at both ends, which is liable to cause interference with poor electrical conductivity, and the smoke compartment is threaded connection in most cases, so that the components are maintained and cleaned in a more cumbersome way, and are installed and replaced inconveniently.

SUMMARY

The present invention aims to provide a combined-type smoke generator, in order to solve the problem that the air inlet of the smoke generator available in the market is installed at both ends, which is liable to cause interference with poor electrical conductivity, and the smoke compartment is threaded connection in most cases, so that the components are maintained and cleaned in a more cumbersome way, and are installed and replaced inconveniently.

To achieve this purpose, the present invention adopts the following technical scheme:

A combined-type smoke generator is provided, comprising a shell, and there is a battery installed on one side of the bottom inside the said shell, there is an electrode needle installed on one side of the top inside the said shell, there is an air pump installed on the other side of the bottom inside the said shell, there is a connecting assembly installed on the other side of the top inside the shell, there is a smoke compartment installed on the left side of the top of the said shell, there is an air inlet installed on the right side of the said smoke compartment, there is a control assembly installed on the front side of the said shell, the top of the said electrode needle is connected to the bottom of the said smoke compartment, the said battery is connected electrically to the said electrode needle, the said air pump is connected through the said connecting assembly to the air inlet of the said smoke compartment, and the said control assembly is connected electrically to the said battery and the said air pump respectively.

As a preferred embodiment of a combine-type smoke generator, the said shell is comprised of a bottom shell, a cover shell, a lower shell, and an upper shell; the said cover shell is installed on the front side of the said bottom shell, the said lower shell is installed on the said bottom shell and the top of the said cover shell, the said upper shell is installed on the top of the said lower shell; there are mounting holes on the bottom of the said bottom shell, there is a plurality of heat emission holes on both sides of the said upper shell, there is a plurality of reinforcing bars inside the said bottom shell used to fix the said battery and the said air pump, there is a slot on one side of the bottom of the said lower shell used to fix the said electrode needle, and there is a guide slot on the other side of the bottom of the said lower shell used to guide the said connecting assembly.

As a preferred embodiment of a combine-type smoke generator, the said connecting assembly is comprised of a guide frame, a connecting tube, a wedge block, a spring, and a push rod, the said guide frame is installed slidably in the guide slot on the bottom of the said lower shell, the said connecting tube is installed on one side of the bottom of the said guide frame, the said wedge block is installed on one side of the top of the said guide frame, the said spring is installed on the right side of the said guide frame inside the guide slot on the bottom of the said lower shell, the said push rod is installed slidably on the right side of the top of the said lower shell, the bottom of the said push rod is connected to the said wedge block to push the said wedge block, so as to compress the said spring.

As a preferred embodiment of a combine-type smoke generator, the said control assembly is comprised of a circuit board, a display screen, and a plurality of keys, the said circuit board is installed on the inner side of the said cover shell, the said display screen is installed on the upper part of the front side of the said circuit board, a plurality of the said keys are installed on the lower part of the front side of the said circuit board, the said circuit board and the said battery are connected to supply power to the said display screen, and the said circuit board, the said display screen, and a plurality of the said keys are connected electrically to control the said air pump to transport gas.

As a preferred embodiment of a combine-type smoke generator, a charging interface is installed on the bottom of the said circuit board passing through the bottom of the said cover shell, the said charging interface supplies the charging power to the said battery through the charging circuit in the said circuit board to replenish and restore the power of the said battery, and the said display screen and a plurality of the said keys pass through the said cover shell, and protrude out of the front side of the said cover shell.

As a preferred embodiment of a combine-type smoke generator, there is a guide rail on the right side of the top of the said lower shell used to facilitate the installation of the said smoke compartment.

Beneficial effects of the present invention:

1. The air inlet is located on the side of the smoke compartment to control the amount of air entering the smoke compartment, and the air or other inert gas is transported to the inside of the smoke generator through the air pump so as to mix with the smoke generating agent and ensure the rapid generation and stable release of the smoke. At the same time, there is a guide slot on the shell used to connect to the smoke compartment and increase the safety operation efficiency.

2. At present, the smoke compartment is changed from the traditional threaded connection to the contact connection, and then connected through the connecting component and fixed, so it is more convenient to install. Two electrodes are led from the bottom of the smoke compartment, corresponding to the positive and negative electrodes respectively. There are two probes installed on the bottom of the smoke compartment of the shell, and the power supply is formed by contacting the probes with the electrodes of the smoke compartment, so as to improve the electrical conductivity.

3. With the integrated components in a compact structure, it is easier to carry the smoke generator, so it is suitable for outdoor shooting or mobile studio. Furthermore, the components are assembled or disassembled conveniently, and maintained and cleaned simply and directly; the control panel and the functional buttons are integrated to make the operation more intuitive and convenient.

BRIEF DESCRIPTION OF THE DRAWINGS

In order to make a clearer explanation to the technical scheme in the embodiments of the present invention, the appended drawings to be used in the embodiments are briefly introduced below. It is obvious that the appended drawings described below are only certain embodiments recorded in the present invention, and the ordinary persons skilled in the art can also obtain other appended drawings on the basis of such appended drawings without the contribution of creative labor.

In the drawings.

1. Shell; 11. Bottom shell; 12. Cover shell; 13. Lower shell; 14. Upper shell; 2. Battery; 3. Electrode needle; 4. Air pump; 5. Connecting component; 51. Guide frame; 52. Connecting tube; 53. Wedge block; 54. Spring; 55. Push rod; 6. Smoke compartment; 7. Control component; 71. Circuit board; 72. Display screen; 73. Buttons.

DETAILED DESCRIPTION OF THE EMBODIMENTS

The technical scheme of the present invention is further explained in combination with the appended drawings and through the specific implementation mode.

Among others, the appended drawings are for illustrative purposes only, and are only schematic drawings but not physical drawings, and cannot be construed as the limitations on the present patent. In order to better illustrate the embodiments of the present invention, certain components in the appended drawings may be omitted, scaled up or scaled down, not representing the actual size of the product. For those skilled in the art, it is understandable that certain prior structures and the descriptions thereof may be omitted in the appended drawings.

In the appended drawings in the embodiments of the present invention, identical or similar labels are used to indicate the identical or similar components with identical or similar functions. In the description of the present invention, it shall be understood that the oriental and positional relationship indicated by the terms such as "up", "down", "left", "right", "inside", and "outside" are based on the oriental and positional relationship indicated in the appended drawings, and for description of the present invention and simplification of the description only, but not intended to indicate or imply that the device or component referred to must have a particular orientation, and must be constructed and operated in a particular orientation. Therefore, in the appended drawings, the terms for description of such positional relationship shall be used only for exemplary description but not be interpreted as the limitation on the present patent. The ordinary persons skilled in the art may understand the meaning of the above terms as the case may be.

In description of the present invention, unless otherwise expressly specified and defined, the "connection" and other terms indicating the connection relation between the components shall be understood in a broad sense; for example, it includes fixed connection, or detachable connection, or integrated connection; mechanical connection, or electrical connection; direct connection, or indirect connection through an intermediate medium, or connection within two components, or the interacting relation between two components. The ordinary persons skilled in the art may understand the meaning of the above terms in the present invention as the case may be.

Figure 1:
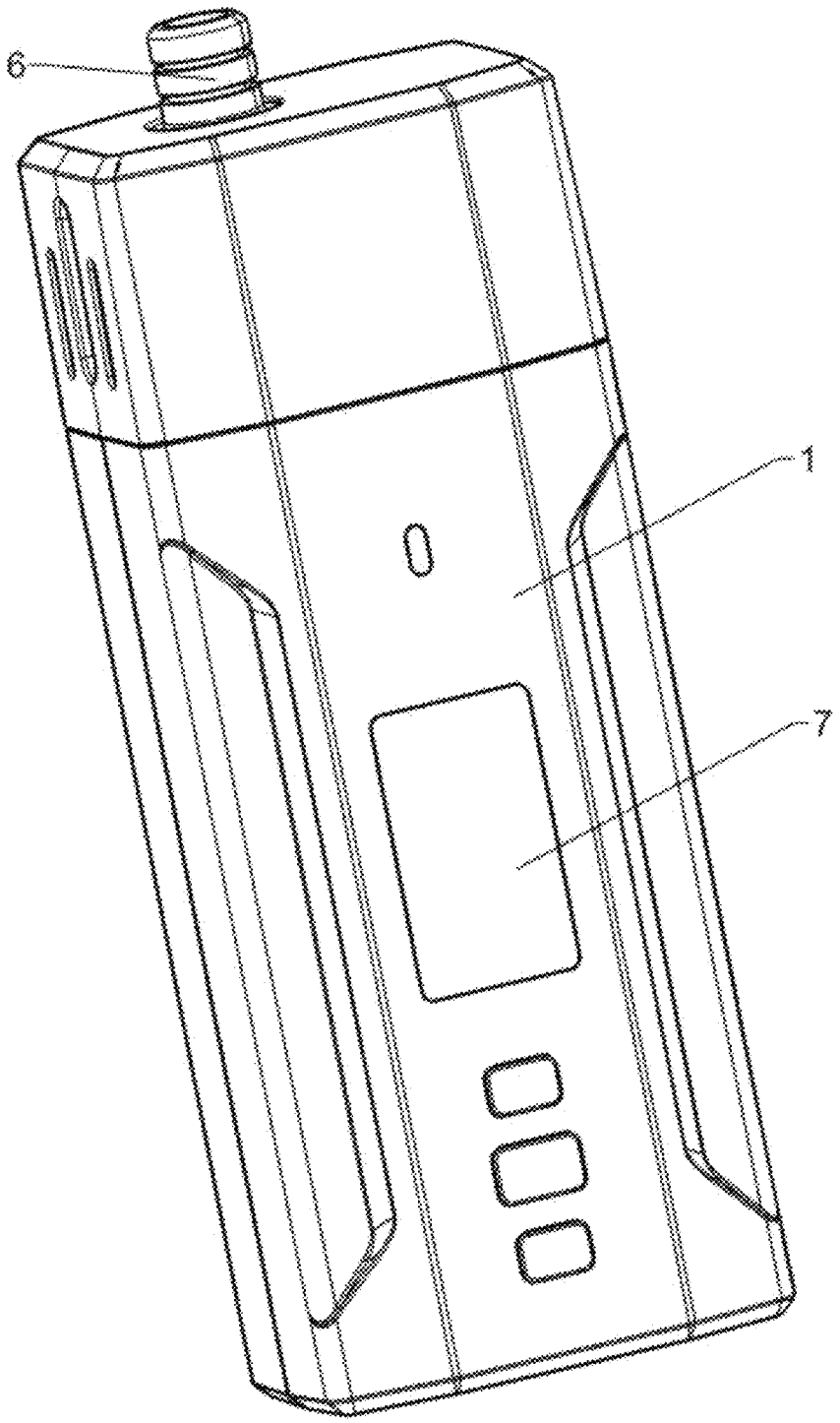
FIG. 1 is the schematic diagram for three-dimensional structure of the combined-type smoke generator as described in an embodiment of the present invention.
Figure 2:
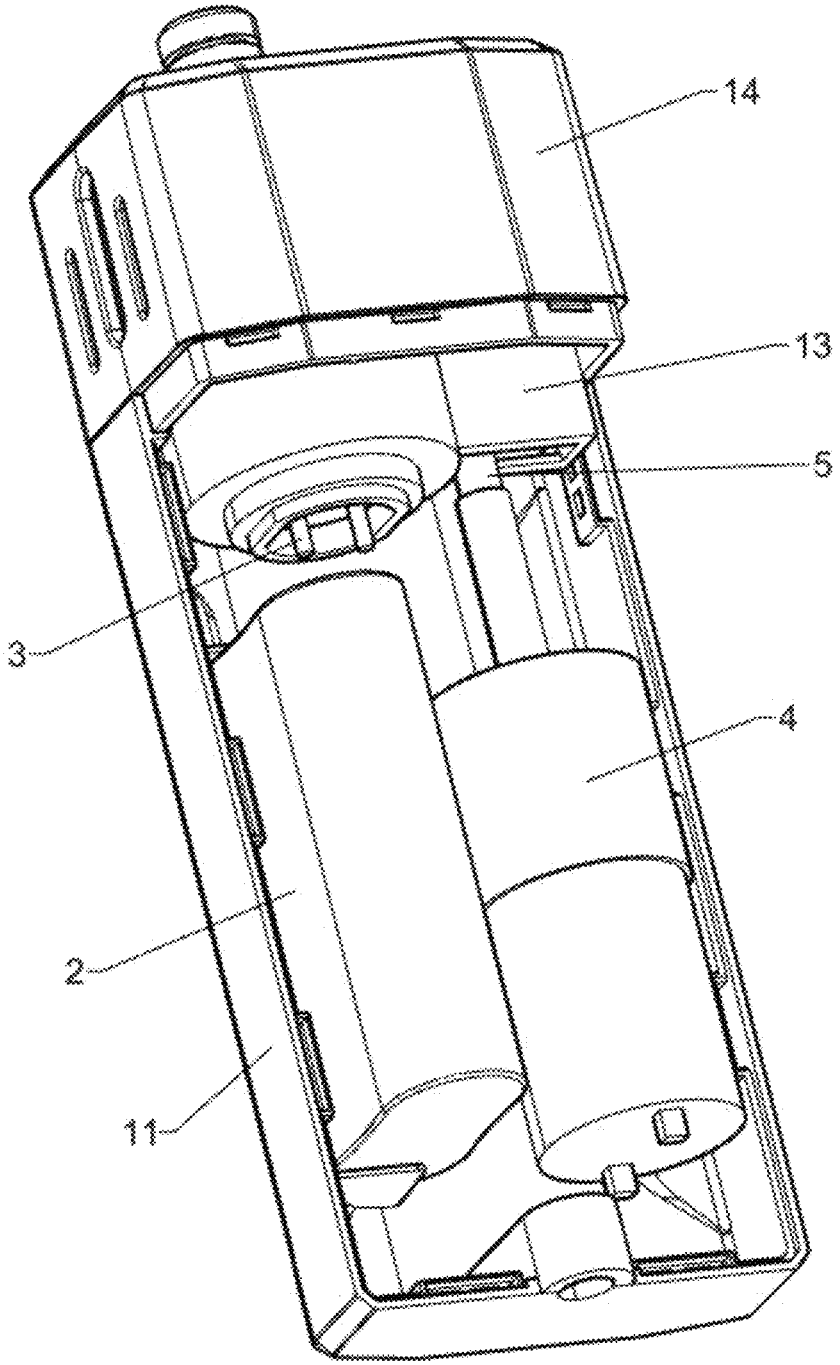
FIG. 2 is the schematic diagram for internal three-dimensional structure of the combined-type smoke generator as described in an embodiment of the present invention.

As shown in FIG. 1 and FIG. 2, the present invention provides the technical scheme: A combined-type smoke generator is comprised of a shell 1, there is a battery 2 installed on the left side of the bottom inside the shell 1, there are two electrode needles 3 installed on the left side of the top inside the shell 1, there is an air pump 4 installed on the right side of the bottom inside the shell 1, there is a connecting assembly 5 installed on the right side of the top inside the shell 1, there is a smoke compartment 6 clamped on the left side of the top inside the shell 1, the smoke compartment 6 is translucent with fluid inside; the smoke compartment 6 is located on the top of electrode needle 3 and the top of the smoke compartment 6 protrudes out of the shell 1; there is an air inlet on the bottom of the right side of the smoke compartment 6, there is an air outlet on the top of the smoke compartment 6, an electrode is fixed on the bottom of the smoke compartment 6 by a swivel buckle, there is a control assembly 7 installed in the middle of the front side of the shell 1, the control assembly 7 is connected to the battery 2 and the air pump 4 respectively, the top of the two electrodes 3 is connected to the electrode fixed on the bottom of the smoke compartment 6 by the swivel buckle, the battery 2 is connected to two electrode needles 3 to control the operating condition of the smoke compartment 6, and the air pump 4 is connected the air inlet of the smoke compartment 6 through the connecting assembly 5 to control and regulate the air flow rate output from the air pump 4, so as to control the amount and the emission rate of the smoke generated in the smoke compartment 6.

Figure 3:
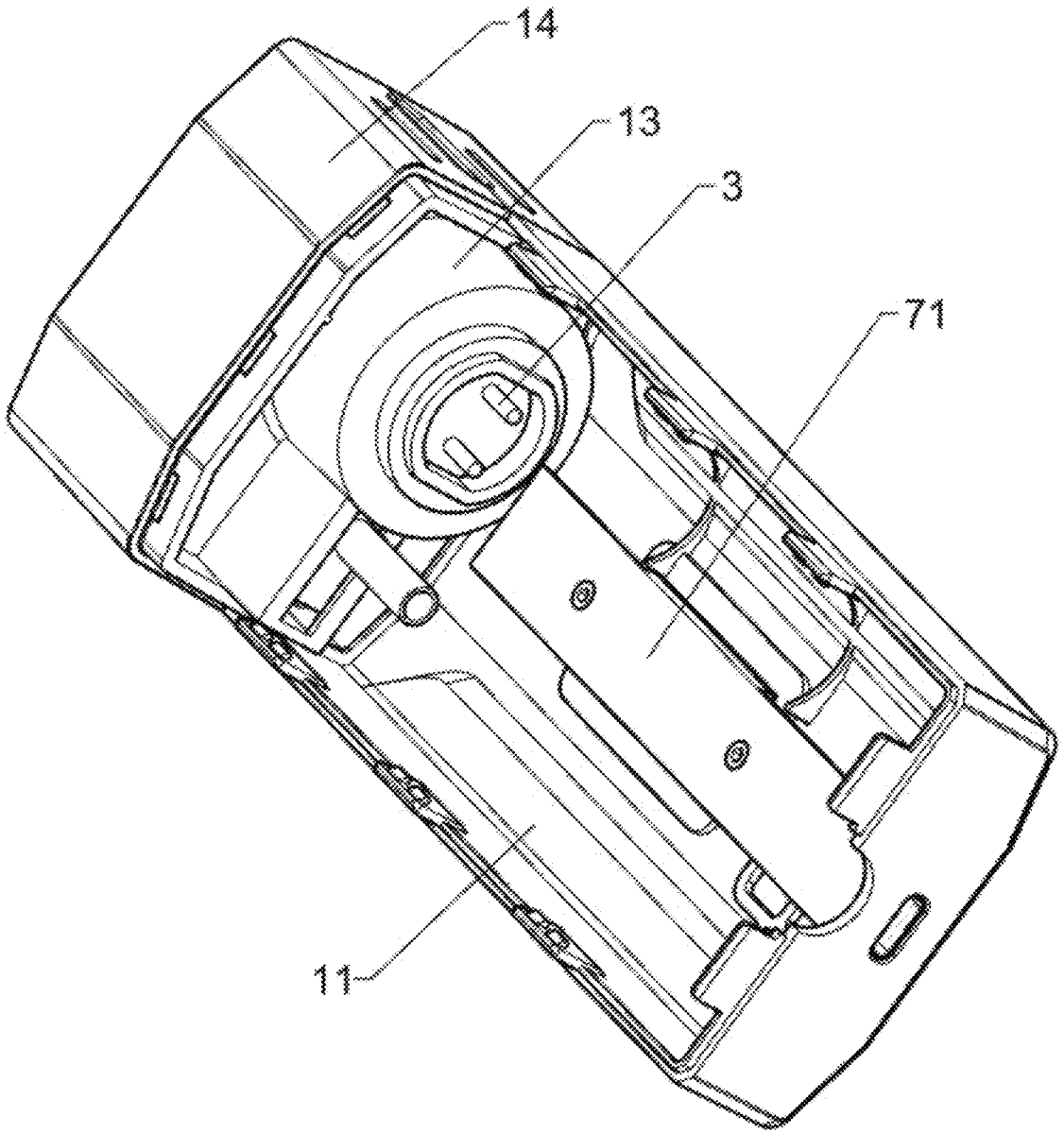
FIG. 3 is the schematic diagram for three-dimensional structure of bottom shell, electrode needle, circuit board, and other parts of the combined-type smoke generator as described in an embodiment of the present invention.

As shown in FIG. 2 and FIG. 3, the shell 1 is comprised of a bottom shell 11, a cover shell 12, a lower shell 13 and an upper shell 14; there is the cover shell 12 clamped on the front side of the bottom shell 11, there is the lower shell 13 clamped on the top of the bottom shell 11 and the cover shell 12, there is the upper shell 14 clamped on the top of the lower shell 13, there is a threaded mounting hole in the middle of the bottom of the bottom shell 11, there are three heat emission holes on the left side and the right side of the upper shell 14 at equal intervals where the heat emission hole in the middle is slightly larger than that on either side; there is a plurality of reinforced bars on the left side and the right inside of the bottom shell 11; there are reinforced bars inside the cover shell 12 corresponding to those on the left side and the right side inside the bottom shell 11, a plurality of reinforcing bars inside the bottom shell 11 are used to reinforce the bottom shell 11 and limit the battery 2 and the air pump 4, and the reinforcing bars on the cover shell 12 are used for secondary limitation of the battery 2 and the air pump 4; the battery 2 and the air pump 4 are fixed between the bottom shell and the cover shell 12; there is a slot on the left side of the bottom of the lower shell 13 used to install and fix the electrode needle 3; there is a guide slot on the right side of the bottom of the lower shell 13 used to guide the connecting assembly 5; there is a guide rail on the left side of the top of the lower shell 13 used to facilitate the installation of the smoke compartment 6; the heat emission holes on both sides of the upper shell 14 are used to connect to the outside world and emit the heat generated in the smoke compartment 6 immediately, and to observe the amount of fluid in the smoke compartment 6 and select to replace the smoke compartment 6 or not; in specific operating conditions, the smoke generator can be fixed on a tripod or other photographic equipment through the threaded mounting holes in the bottom shell 11.

Figure 4:
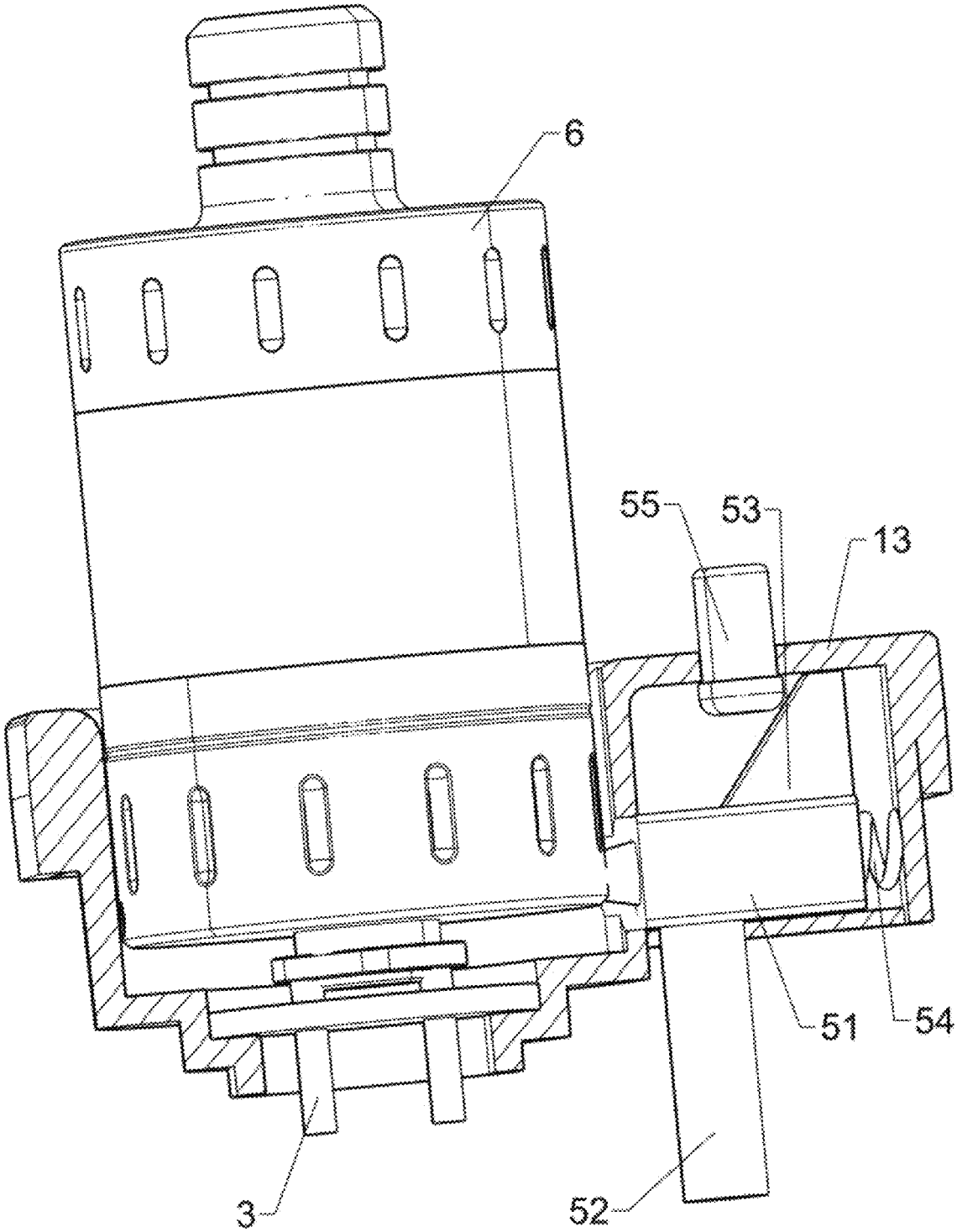
FIG. 4 is the schematic diagram for sectional structure of the lower shell of the combined-type smoke generator as described in an embodiment of the present invention.

As shown in FIG. 4, the connecting assembly 5 is comprised of a guide frame 51, a connecting tube 52, a wedge block 53, a spring 54 and a push rod 55; the guide frame 51 is installed slidably in the guide slot on the bottom of the lower shell 13, there are air channels inside the guide frame 51 connected to the air pump 4 and the smoke compartment 6, there is a clamping joint on the left side of the guide frame 51 corresponding to the air inlet of the smoke compartment 6, there is an air channel in the clamping joint connected to the air inlet of the smoke compartment 6 and then to the smoke compartment 6; the connecting tube 52 is installed on the left side of the bottom of the guide frame 51, there is a hollow inside the connecting tube 52 connected to the air channel inside the guide frame 51; the wedge block 53 is installed on the right side of the top of the guide frame 51, the right slope of the wedge block 53 presents a progressive thinning relative to the left slope; there is a guide hole on the right side of the guide frame 51, there is a spring 54 installed between the right side inside the guide hole of the guide frame 51 and the left side of the guide slot, the push rod 55 is installed slidably on the right side of the top of the lower shell 13 passing through the lower shell 13, and the bottom of the push rod 55 is connected to the top slope on the right side of the wedge block 53; the air in the air pump 4 flows through the connecting tube and the air channel inside the guide frame 51 into the smoke compartment 6 to control the generation of smoke; if the smoke compartment 6 shall be replaced, take off the upper shell 14 upwards, and then press down the push rod 55 downwards; under the downward pressure, the push rod 55 pushes the wedge block 53 to move to the right, the wedge block 53 moves to the right to drive the guide frame to move to the right and compress the spring 54 to drive the clamping joint to detach from the air inlet of the smoke compartment 6; thereafter, take out the smoke compartment 6; after taking out and replacing the smoke compartment 6, release the push rod 55, the spring 54 is reset and restored to the normal state; push the guide frame 51 leftwards to move to the left, the guide frame 51 moves to the left so that the clamping joint is in contact with the air inlet of the smoke compartment 7 and fixed; at the same time, the guide frame 51 moves to the left to jack up the push rod 55, and put on the upper shell 14 and fix the smoke compartment 6 replaced.

Figure 5:
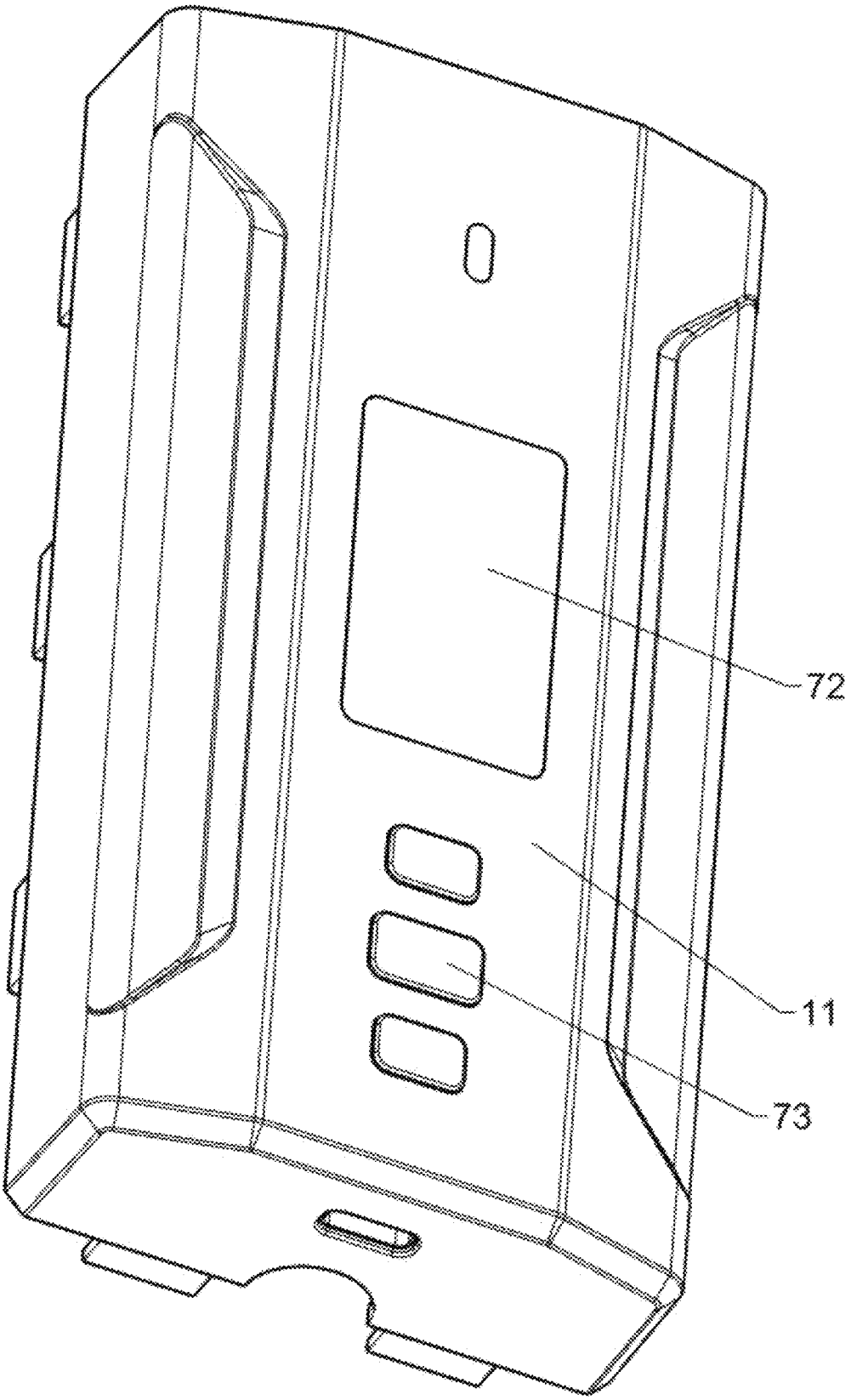
FIG. 5 is the schematic diagram for three-dimensional structure of the control assembly of the combined-type smoke generator as described in an embodiment of the present invention.

As shown in FIG. 3 and FIG. 5, the control assembly 7 is comprised of a circuit board 71, a display screen 72, and three buttons 73. A circuit board 71 is installed in the middle of the inner side of the cover shell 12 with screws, the circuit board 71 is electrically connected to the battery 2 and the air pump 4 respectively; the display screen 72 is installed in the upper part of the front side of the circuit board 71, and a switch is also installed on the upper part of the front side of the circuit board 71, the switch is located on the up side of the display screen 42, and three buttons 73 are installed in the lower part of the front side of the circuit board 71 at equal intervals; a charging interface is installed on the bottom of the circuit board 71 passing through the bottom of the cover shell 12; the display screen 72, the switch, and the three buttons 73 pass through the cover shell 12, and protrude out of the front side of the cover shell 12; the circuit board 71 is electrically connected to the battery 2 to supply power to the display screen 72 to display information; the circuit board 71, the switch, the display screen 72, and the three buttons 73 are connected electrically to control the air pump 4 to transport gas; the charging interface may be connected to the external power supply to supply charging power to the battery 2 through the charging circuit in the circuit board 72, so as to replenish or restore the power of the battery 2.

Working principle: When using the smoke generator, start the switch on the circuit board 71, observe the information on the display screen 72 and operate the buttons 73 to control and regulate the flow rate of air output from the air pump 4 so as to control the amount and emission rate of the smoke generated in the smoke compartment 6; if the fluid in the smoke compartment 6 is used up and the smoke compartment 6 shall be replaced, take off the upper shell 14 upwards, and then press down the push rod 55 downwards; under the downward pressure, the push rod 55 pushes the wedge block 53 to move to the right, the wedge block 53 moves to the right to drive the guide frame to move to the right and compress the spring 54 to drive the clamping joint to detach from the air inlet of the smoke compartment 6; thereafter, take out the smoke compartment 6; after taking out and replacing the smoke compartment 6, release the push rod 55, the spring 54 is reset and restored to the normal state; push the guide frame 51 leftwards to move to the left, the guide frame 51 moves to the left so that the clamping joint is in contact with the air inlet of the smoke compartment 7 and fixed; at the same time, the guide frame 51 moves to the left to jack up the push rod 55, and put on the upper shell 14 and fix the smoke compartment 6 replaced. When the power in battery 2 is used up, connect the external power supply to supply charging power to the battery 2 through the charging circuit in the circuit board 72, so as to replenish or restore the power of the battery 2, or open the cover shell 12 to replace the battery 2 directly.

It should be stated that the above embodiments are just the optimal ones of the present invention and the technical principles applied. The persons skilled in the art shall understand that various modifications, equivalent replacements, and changes can also be made to the present invention. However, as long as these transformations do not deviate from the spirit of the present invention, they shall be included within the protection scope of the present invention. In addition, certain terms used in the specification and the claims are not limitations, but for easy description only.

What is claimed is:

1. A combined-type smoke generator, comprising a shell, wherein a battery is installed on a first side of a bottom inside the shell, an electrode needle is installed on a first side of a top inside the shell, an air pump is installed on a second side of the bottom inside the shell, a connecting assembly is installed on a second side of the top inside the shell, a smoke compartment is installed on a left side of a top of the shell, an air inlet is installed on a right side of the smoke compartment, a control assembly is installed on a front side of the shell, a top of the electrode needle is connected to a bottom of the smoke compartment, the battery is connected electrically to the electrode needle, the air pump is connected through the connecting assembly to the air inlet of the smoke compartment, and the control assembly is connected electrically to the battery and the air pump respectively.

2. The combined-type smoke generator according to claim 1, wherein the shell comprises a bottom shell, a cover shell, a lower shell, and an upper shell, wherein the cover shell is installed on a front side of the bottom shell, the lower shell is installed on the bottom shell and a top of the cover shell, the upper shell is installed on a top of the lower shell; a plurality of mounting holes are provided on a bottom of the bottom shell, a plurality of heat emission holes are provided on both sides of the upper shell, a plurality of reinforcing bars are provided inside the bottom shell and configured to fix the battery and the air pump, a slot is provided on a first side of a bottom of the lower shell and configured to fix the electrode needle, and a guide slot is provided on a second side of the bottom of the lower shell and configured to guide the connecting assembly.

3. The combined-type smoke generator according to claim 2, wherein the connecting assembly comprises a guide frame, a connecting tube, a wedge block, a spring, and a push rod, wherein the guide frame is installed slidably in the guide slot on the bottom of the lower shell, the connecting tube is installed on a side of a bottom of the guide frame, the wedge block is installed on a side of a top of the guide frame, the spring is installed on a right side of the guide frame inside the guide slot on the bottom of the lower shell, the push rod is installed slidably on a right side of the top of the lower shell, and a bottom of the push rod is connected to the wedge block to push the wedge block, so as to compress the spring.

4. The combined-type smoke generator according to claim 2, wherein the control assembly comprises a circuit board, a display screen, and a plurality of keys, wherein the circuit board is installed on an inner side of the cover shell, the display screen is installed on an upper part of a front side of the circuit board, the plurality of keys are installed on a lower part of the front side of the circuit board, the circuit board and the battery are connected to supply power to the display screen, and the circuit board, the display screen, and the plurality of keys are connected electrically to control the air pump to transport a gas.

5. The combined-type smoke generator according to claim 4, wherein a charging interface is installed on a bottom of the circuit board passing through a bottom of the cover shell, the charging interface supplies charging power to the battery through a charging circuit in the circuit board to replenish and restore power of the battery, and the display screen and the plurality of keys pass through the cover shell, and protrude out of a front side of the cover shell.

6. The combined-type smoke generator according to claim 2, wherein a guide rail is provided on a right side of the top of the lower shell and configured to facilitate an installation of the smoke compartment.

* * * * *